United States Patent [19]

Laux et al.

[11] 4,086,052

[45] Apr. 25, 1978

[54] CERAMIC BURNER FOR COMBUSTION CHAMBER FOR HOT-BLAST STOVE

[75] Inventors: Walter Laux, Wiesbaden; Rudolf Hebel, Ginsheim/Gustavsburg; Rolf Schneider, Nauheim, all of Germany

[73] Assignee: Didier-Werke AG, Wiesbaden, Germany

[21] Appl. No.: 723,936

[22] Filed: Sep. 16, 1976

[30] Foreign Application Priority Data

Sep. 20, 1975 Germany ..... 2541991

[51] Int. Cl.[2] ..... F23L 9/04

[52] U.S. Cl. ..... 432/217; 239/419; 239/424.5; 431/187

[58] Field of Search ..... 431/181, 182, 185, 186, 431/187, 202, 354; 432/217, 218; 239/403, 419, 424.5

[56] References Cited

U.S. PATENT DOCUMENTS

| | | | |
|---|---|---|---|
| 1,991,894 | 2/1935 | Forney | 431/185 X |
| 2,815,069 | 12/1957 | Garraway | 431/185 X |
| 3,568,932 | 3/1971 | Van Laar et al. | 239/424.5 |
| 3,837,793 | 9/1974 | Lucieer et al. | 432/217 |
| 3,891,384 | 6/1975 | Hovis et al. | 432/217 |

*Primary Examiner*—Edward G. Favors
*Attorney, Agent, or Firm*—Wenderoth, Lind & Ponack

[57] ABSTRACT

A burner includes a central burner duct for passing combustion gas therethrough and an outer annular duct for the passage of combustion air and coaxial to the central burner duct. The ducts open or join at an opening area, upstream of which are one or two areas where the combustion gas and air are combined or brought together and mixed. A disk-shaped mixing element is positioned within the opening area centrally thereof and downstream of the first combination area and adjacent the second combination area. The mixing element has extending therethrough substantially in the direction of flow, a ring of separate passages.

17 Claims, 9 Drawing Figures

CERAMIC BURNER FOR COMBUSTION CHAMBER FOR HOT-BLAST STOVE

BACKGROUND OF THE INVENTION

The present invention relates to a burner, particularly a ceramic burner for use in the combustion shaft of a hot-blast stove, of the type including concentric chambers for the combustion media, e.g. combustion air and gas, which chambers are joined at an opening area of the combustion shaft, and a mixing element arranged centrally within such opening area.

Especially in hot-blast stoves having large dimensions, and which therefore are acted upon by large volumes of combustion media, it is extremely difficult to control the mixing of combustion air and combustion gas. This is particularly true since it is not possible to avoid variations in the burner load produced by variations in the heating value of the supply of combustion gas. Defective mixing as a preliminary stage for combustion again leads to an irregular combustion. There results an unstable burning which results in abnormal stresses, chiefly on the combustion shaft. When mixing is totally insufficient, combustion takes place in the form of constantly repeating explosion-type ignitions having distinct pressure amplitudes and oscillation periods. The burner pulsates noticeably. Such pulsation is propagated to the various parts of the hot-blast stove installations, e.g. the pipeline systems, and may produce considerable damage thereto.

German published application DT-OS No. 1,551,828/24c,10 discloses a hot-blast stove burner wherein the flow rate and the direction of flow of air and combustion gas are adjustably controlled in an attempt to secure an extensive mixing effect. Regulation is effected by means of an inner cone that is displaceable in the vertical direction, thereby widening the flow through the central burner chamber in an annular manner, and that is introduced into a similarly annular flow through an outer burner chamber. This arrangement does not however result in mixing and distribution of the air and combustion gas through the entire cross section of the combustion shaft at the opening of large volume hot-blast stove burners.

SUMMARY OF THE INVENTION

The object of the present invention is to improve the mixing effect, especially on large volume burners, while allowing variations in load and/or forces acting on the burner, insofar as such variations are within the scope of normal operationally caused variations of the combustion gas.

This object is achieved in accordance with the present invention by providing a disk-shaped mixing element, having therethrough a ring of passage openings extending substantially in the direction of flow, behind or downstream of a position of the burner whereat there is achieved at least a partial combination of the combustion media. Such a structure and arrangement of the mixing element produces more uniform flow rates together with strongly varying directions of flow, thereby resulting in an intensive mixing of air and combustion gas, so as to secure more stable combustion and to avoid disturbing pulsation.

The mixing element advantageously covers 25 to 40% of the cross-sectional area of the central burner duct, while the total cross-sectional area of the passages of the mixing element equals 10 to 30% of the total cross-sectional area of the mixing element. Even under differential loads of the burner, these surface ratios produce excellent mixing results, particularly in combination with the following further features of the invention. Specifically, the passages are arranged on a circle coaxial with the axis of the mixing element, with the central axes of the passages diverging outwardly in the direction of flow and being inclined up to 20° circumferentially of the circle. The height of each of the mixing element passages is 2.5 to 4 times the diameter thereof. The diameter of the circle is 50 to 70% of the outer diameter of the mixing element.

In burners employing two-stage combination of the combustion media, i.e. a primary and a secondary introduction of the annular flow of air into the concentric full-cross-sectional flow of combustion gas, the mixing element is expediently provided at the level of the second combination. The mixing element provides maximum mixing effect at such a position.

The mixing element in accordance with the invention has a convex upper surface and a plane lower surface. The plane surface provides a damming effect to the ascending media, and therefore the flow of the media through the passages of the mixing element is achieved at equal quantitative proportions, while the convex surface promotes the development of identical flow rates of all portions of the media.

The mixing element preferably is formed of a ceramic material body member and a metal base plate. Preferably, the mixing element is carried by a plurality of brickwork brackets extending inwardly from the wall of the central burner duct to the central axis of the burner, the mixing element being joined directly or indirectly to such brackets. Preferably, there are provided three brickwork brackets that divide the central burner duct in three similar longitudinal chambers each having a sectorial cross section. This arrangement provides the advantage of rendering uniform the flow through all portions of the cross section of the central burner duct.

In many cases, mainly involving the later incorporation of the mixing element into an existing hot-blast stove burner, it is of advantage to arrange the mixing element on a steel column, which is positioned at the longitudinal central axis of the burner by means of transverse and bottom anchors. This makes it possible to mount the mixing element in a simple manner, even when the hot-blast stove is stopped only for a short time.

When the mixing element is mounted on such a steel column, the mixing element may be provided with outlet nozzles, and the steel column may be provided with feed ducts for the supply of combustion media for a starting or pilot burner.

BRIEF DESCRIPTION OF THE DRAWINGS

The invention will be described in more detail below with reference to the exemplified embodiments thereof illustrated in the accompanying drawings, wherein.

DETAILED DESCRIPTION OF THE INVENTION

Figure 1:
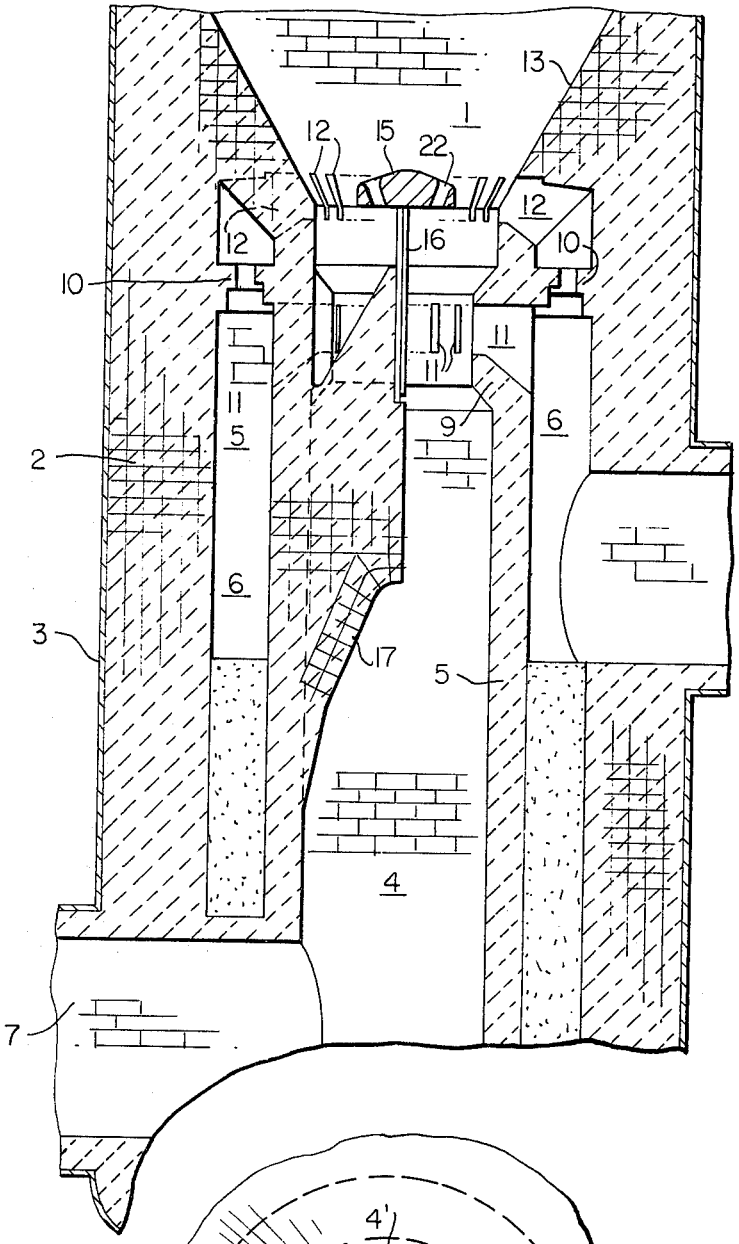
FIG. 1 is a longitudinal section of a novel ceramic burner which is arranged in the base of the combustion shaft of a hot-blast stove and which is equipped with a mixing element.
Figure 2:
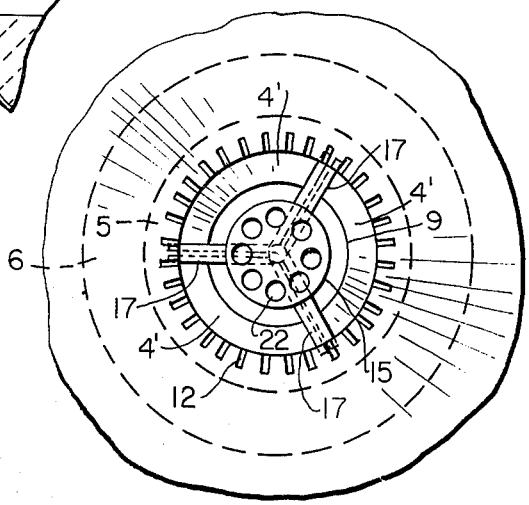
FIG. 2 is a plan view of the central portion of FIG. 1.

With reference to FIGS. 1 and 2, a combustion shaft 1 of a hot-blast stove includes a refractory brickwork 2 and a sheet metal casing 3 surrounding the brickwork 2. A burner of refractory material is arranged in the base of combustion shaft 1 and includes a duct 4 concentric to the axis of the combustion shaft 1, and an annular duct 6 which is separated from duct 4 by an annular wall 5 and which is defined on the outer side or surface thereof by brickwork 2 of combustion shaft 1. Ducts 4 and 6 are provided with feed ducts 7 and 8, respectively. Feed ducts 7 and 8 respectively supply combustion components or media to ducts 4 and 6 and are oriented transversely to the longitudinal axes of ducts 4 and 6. Feed duct 7 of central duct 4 is arranged at the bottom of combustion shaft 1, while feed duct 8 associated with annular duct 6 is situated above feed duct 7. Each burner duct 4 and 6 is provided with a constriction orifice 9 and 10, respectively, which are formed by projections of the respective brickwork. Orifice 9 of central duct 4 is formed by brickwork wall 5 projecting inwardly in the form of a first ring nozzle having openings 11 therethrough which connect annular duct 6 to central duct 4. Above constriction orifice 10 at the top portion of annular duct 6, there is situated a second ring nozzle having openings 12 therethrough which also connect annular duct 6 to central duct 4 at a position above openings 11. Above openings 12 is burner opening 13 which widens upwardly toward the wall of combustion shaft 1.

Within duct 4, at approximately the vertical height of openings 12, and along the central longitudinal axis of the burner is a mixing element 15 supported by a column 16, which is supported by brickwork brackets 17 extending from the wall of central duct 4 inwardly toward the central longitudinal axis of the burner. In the illustrated arrangement there are provided three brickwork brackets 17 arranged in the form of a star and dividing central duct 4 in three identical conducting sections 4'.

Figure 3:
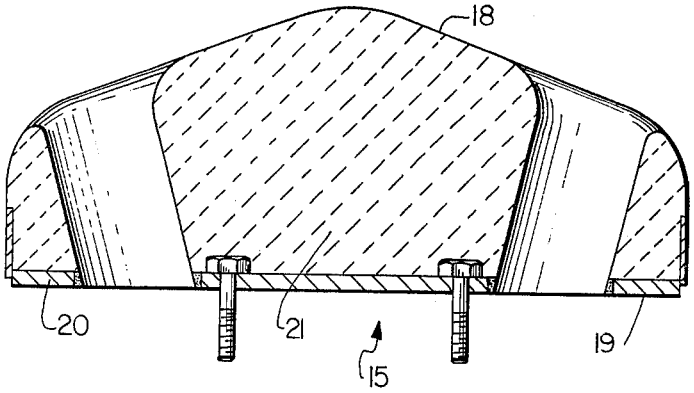
FIG. 3 is a longitudinal section, on an enlarged scale, of the mixing element of the burner of FIGS. 1 and 2.
Figure 4:
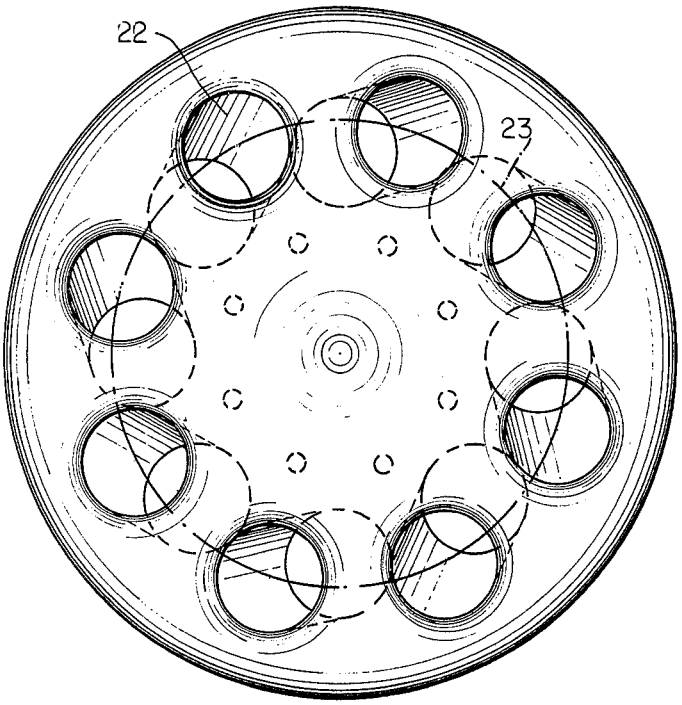
FIG. 4 is a plan view of the mixing element of FIG. 3.

As seen most clearly in FIGS. 3 and 4, mixing element 15 has the shape of a round disk comprising a convex top surface 18 and a plane base surface 19. Mixing element 15 includes a metal base plate 20 and a refractory top body member 21. Mixing element 15 has a plurality, e.g. eight, passage openings 22 extending therethrough. Openings 22 are all arranged around the circumference of a circle 23 concentric with the vertical central axis of mixing element 15, preferably with the axes of openings 22 at the upper ends thereof intersecting circle 23. Openings 22 each diverge upwardly and outwardly from base surface 19 to top surface 18, and openings 22 are also inclined in the circumferential direction of circle 23. Thus, a curved surface including the axes of openings 22 will be in the form of an upwardly widening cone. Perferably, the angle of inclination of the sides of such cone to the central longitudinal axis of mixing element 15 is 10° to 20°. Also preferably, the angle of inclination of the axes of openings 22 to radial planes through the central longitudinal axis of mixing element 15 is 10° to 20°.

The horizontal area of mixing element 15 preferably covers 25 to 40% of the horizontal cross-sectional area of the central burner duct. The total horizontal cross-sectional area of openings 22 equals 10 to 30% of the total horizontal cross-sectional area of mixing element 15. The height of each opening 22 is 2.5 to 4 times the diameter thereof. The diameter of circle 23, located on top surface 18, is 50 to 70% of the outer diameter of mixing element 15.

The above dimensional limitations and features produce excellent mixing of the combustion media by the mixing element 15.

The above described burner operates in the following manner.

Combustion gas flows through feed duct 7 into central burner duct 4, and combustion air flows through feed duct 8 into annular duct 6. When ascending in central duct 4, all of the combustion gas is oriented in the same direction of flow along brickwork brackets 17 and is distributed with uniform density throughout the cross section of flow by constriction orifice 9. The air flow in annular duct 6 is similarly subjected, by constriction orifice 10, to a uniform density distribution and to compression throughout the cross section of flow. Therefore, a first combination of air and combustion gas is effected at the first ring nozzle as a partial amount of air which flows over from annular duct 6 through openings 11, with the flow through the various openings being equal and uniform.

The first gas mixture produced at the first ring nozzle flows upwardly and passes mixing element 15, which exerts a damming effect on the flow. A partial quantity of the gas mixture flows past mixing element 15 around the periphery thereof, while the remaining fraction of the gas mixture passes through passage openings 22. The peripheral annular flow around mixing element 15 is admixed with the residue of combustion air arriving from constriction orifice 10 through openings 12 in the second ring nozzle to form a second gas-air combination or mixture, while the fraction of the first gas mixture passing through passage openings 22 exits therefrom in the form of a diverging annular fan of gas mixture jets. Due to this configuration, such fraction of the first gas mixture is intimately mixed with the second gas mixture produced between mixing element 15 and the second ring nozzle, so as to form a homogeneous mixed flow distributed uniformly through the cross section of the burner opening.

Figure 5:
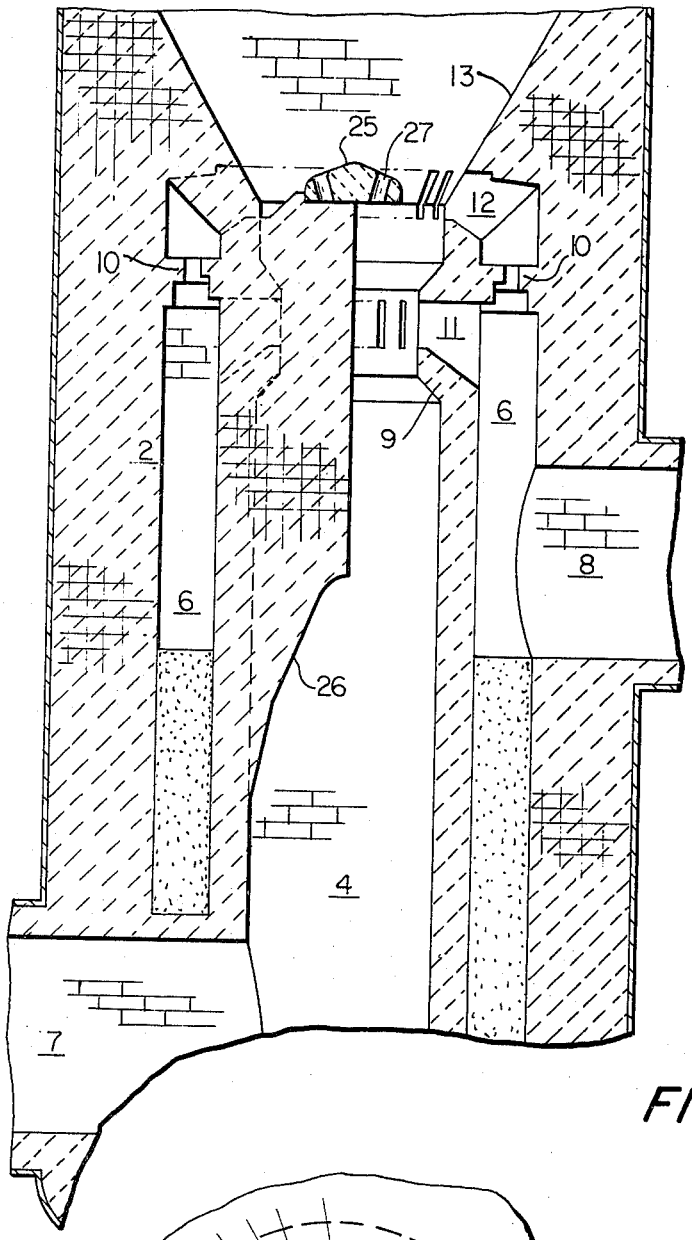
FIGS. 5 and 6 are views similar to FIGS. 1 and 2, respectively, of a second embodiment of the invention.
Figure 6:
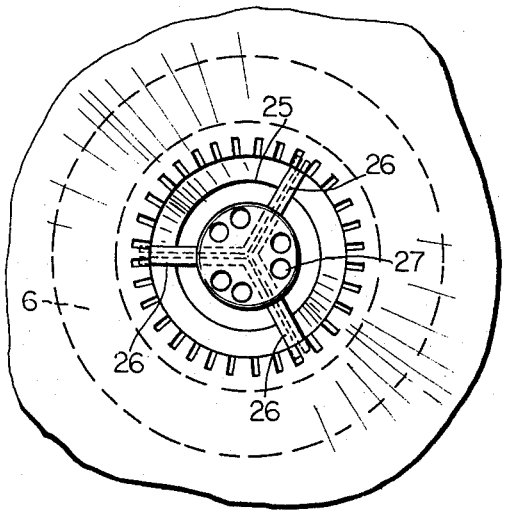

FIGS. 5 and 6 illustrate a second embodiment of the burner wherein, as a modification of the burner of FIGS. 1 and 2, a mixing element 25 is directly mounted in brickwork brackets 26, two passage openings 27 being provided through mixing element 25 between each pair of adjacent brackets.

Figure 7:
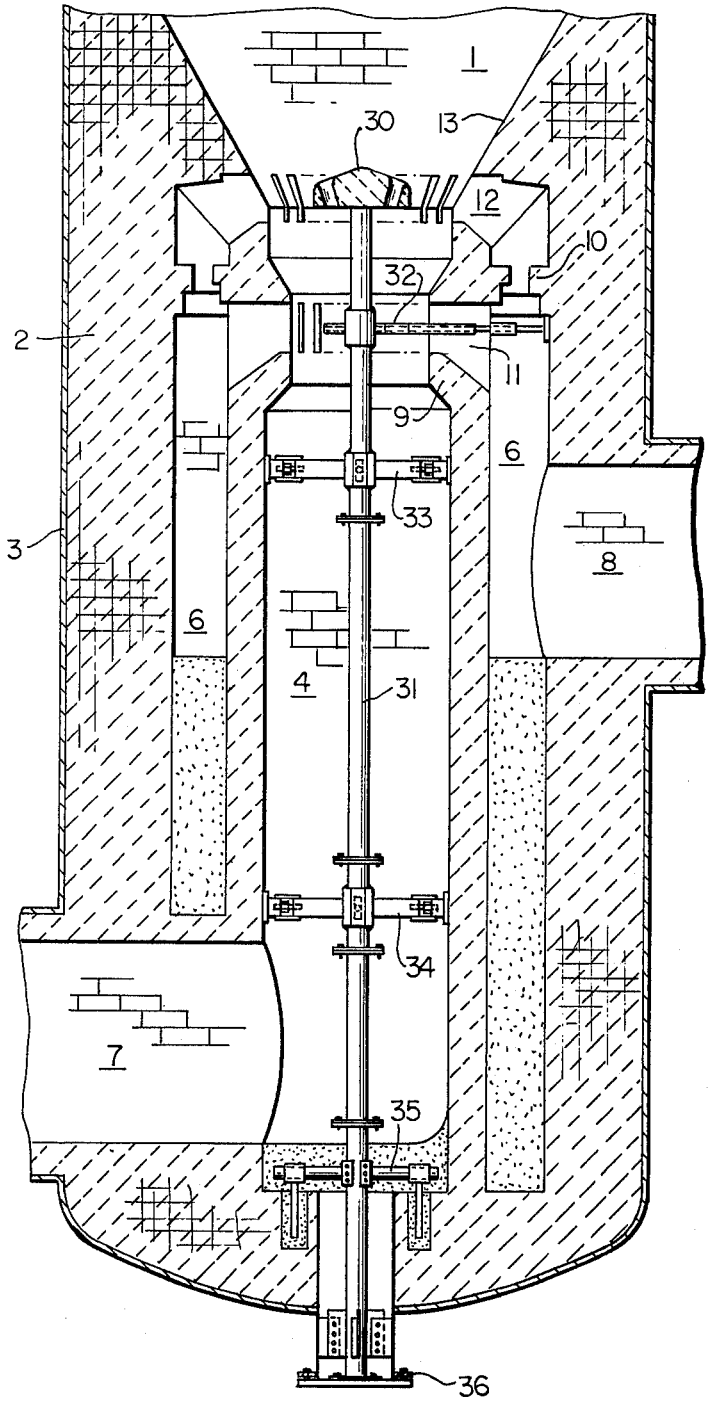
FIG. 7 is a view similar to FIGS. 1 and 5 of a third embodiment of the invention.

In a third embodiment of the invention, as shown in FIG. 7, a mixing element 30 is mounted on and supported by a metal, e.g. steel, column 31 positioned at the central longitudinal axis of the burner. This embodiment has no brickwork brackets 17 or 26. Column 31 is supported by transverse ties or anchors 32, 33 and 34, and column 31 extends to the exterior of combustion shaft 1 through the bottom thereof. Column 31 is further supported by a bottom anchor 35 provided in the bottom area of the combustion shaft, and a flange coupling 36, still further supporting column 31, is attached to sheet metal casing 3 exterior of the combustion shaft. Upper transverse anchor 32 extends through an opening 11 of the first ring nozzle and abuts against the wall of refractory brickwork 2, while anchors 33 and 34 contact the wall of central combustion shaft 4.

Figure 8:
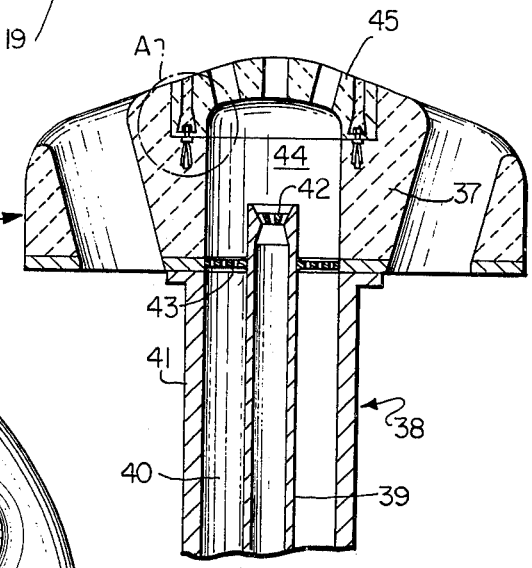
FIG. 8 is a section, on an enlarged scale, of the mixing element arrangement of the burner of FIG. 7.
Figure 9:
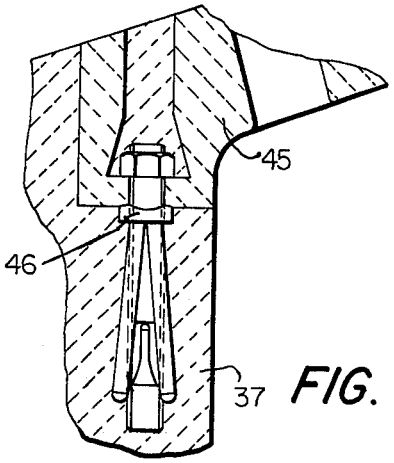
FIG. 9 is a further enlarged detail view of the area A of FIG. 8.

As shown in FIGS. 8 and 9, a mixing element 30 and a steel column 38, in accordance with the invention, may be constructed as a pilot or starting burner. Column 38 is in the form of a double pipe, wherein fuel is fed through an inner pipe 39, while combustion air is fed through annular space 40 between an outer pipe 41 and inner pipe 39. Pipes 39 and 41 are provided with respective constriction orifices 42 and 43, each of which end in a mixing chamber 44 provided centrally within refractory body member 37 of mixing element 30. A nozzle plate 45 is imbedded within body member 37 and connects mixing chamber 44 with the combustion shaft. Plate 45 is fastened to body member 37, e.g. by means of tap bolts and anchors 46, such as shown in FIG. 9.

It is to be understood that modifications may be made to the above specifically described structural arrangements without departing from the scope of the present invention.

What is claimed is:

1. A burner, particularly for use in the combustion shaft of a hot-blast stove, said burner comprising:

a central burner duct for the supply of a first combustion component;

an outer annular duct, coaxial to said central burner duct, for the supply of a second combustion component;

means connecting said central burner duct and said outer annular duct for combining first and second combustion components flowing therethrough to form a component mixture;

a disk-shaped mixing element means, positioned centrally within said central burner duct at a position downstream in the direction of flow of said combustion components of said combining means, for retarding the flow of said component mixture in the downstream direction;

said mixing element means occupying a portion only of the cross-sectional area of said central burner duct, such that a first portion of said component mixture flows past said mixing element means around the periphery thereof; and said mixing element means having extending therethrough, substantially in the direction of flow of said combustion components, a ring of separate passages such that a second portion of said component mixture flows through said separate passages and mixes with said first portion of said component mixture.

2. A burner as claimed in claim 1, wherein said central burner duct and said outer annular duct are defined by ceramic material, and said mixing element means is substantially formed by ceramic material.

3. A burner as claimed in claim 1, wherein the cross-sectional area of said mixing element means equals 25 to 40% of the cross-sectional area of said central burner duct.

4. A burner as claimed in claim 1, wherein the total cross-sectional area of said passages equals 10 to 30% of the total cross-sectional area of said mixing element means.

5. A burner as claimed in claim 1, wherein the height of each said passage is 2.5 to 4 times the diameter thereof.

6. A burner as claimed in claim 1, wherein said passages are arranged on a circle coaxial to the longitudinal central axis of said mixing element means.

7. A burner as claimed in claim 6, wherein the central axes of said passages diverge outwardly in the direction of flow and are inclined in the circumferential direction of said circle.

8. A burner as claimed in claim 7, wherein the degree of divergence and inclination of said passage axes is up to 20°.

9. A burner as claimed in claim 8, wherein the degree of divergence and inclination of said passage axes is from 10 to 20°.

10. A burner as claimed in claim 6, wherein the diameter of said circle equals from 50 to 70% of the outer diameter of said mixing element means.

11. A burner as claimed in claim 1, further comprising second means connecting said central burner duct and said outer annular duct for combining said first and second combustion components, said second combining means being downstream of said first-mentioned combining means, said mixing element means being positioned in the area of said second combining means.

12. A burner as claimed in claim 1, wherein said ducts extend vertically, and said mixing element means has a convex upper surface and a planar lower surface.

13. A burner as claimed in claim 12, wherein said mixing element means comprises a ceramic body member and a metal base plate.

14. A burner as claimed in claim 1, further comprising a plurality of brickwork brackets extending inwardly from the wall of said central burner duct toward the central axis of the burner, said mixing element means being supported by said brackets.

15. A burner as claimed in claim 14, comprising three said brackets dividing said central burner duct into three identical longitudinal chambers, each having a sectorial cross-sectional configuration.

16. A burner as claimed in claim 1, further comprising a metal column positioned along the central longitudinal axis of the burner, said mixing element means being supported by said column.

17. A burner as claimed in claim 16, further comprising a mixing chamber within said mixing element means, a nozzle leading from said mixing chamber, and feed ducts passing through said column into said mixing chamber for the supply thereto of pilot burner combustion media.

* * * * *